US006945474B1

(12) United States Patent
Chen

(10) Patent No.: US 6,945,474 B1
(45) Date of Patent: Sep. 20, 2005

(54) PISTOL-TYPE NOZZLE OF GARDENING SPRINKLER

(76) Inventor: Chin-Yuan Chen, P.O. Box 453, Taichung (TW)

( * ) Notice: Subject to any disclaimer, the term of this patent is extended or adjusted under 35 U.S.C. 154(b) by 71 days.

(21) Appl. No.: 10/426,800

(22) Filed: May 1, 2003

(51) Int. Cl.[7] ..... B05B 07/02
(52) U.S. Cl. ..... 239/526; 239/525; 239/600
(58) Field of Search ..... 239/525, 526, 239/530, 600

(56) References Cited

U.S. PATENT DOCUMENTS 5,772,121 A * 6/1998 Wang ..... 239/394
6,230,988 B1 * 5/2001 Chao ..... 239/394
6,254,016 B1 * 7/2001 Chao ..... 239/526
6,536,688 B1 * 3/2003 Chun-Lee ..... 239/581.1
6,540,159 B1 * 4/2003 Wang ..... 239/525
6,540,163 B1 * 4/2003 Huang ..... 239/587.5
2002/0190141 A1 * 12/2002 Huang ..... 239/526
2003/0192964 A1 * 10/2003 Foster et al. ..... 239/525

* cited by examiner

*Primary Examiner*—Thomas Denion
*Assistant Examiner*—Diem Tran
(74) *Attorney, Agent, or Firm*—Alan D. Kamrath; Nikolai & Mersereau, P.A.

(57) ABSTRACT

A pistol-type nozzle comprises a hand grip, a barrel, a spray head, and a trigger. The barrel has a muzzle which is provided with two retaining slots, each being formed of a guide portion and a retaining portion. The retaining portion is provided with a retaining ridge to arrest a retaining projection of a connection end of the spray head. The trigger is provided with a cover which has a soothing effect.

4 Claims, 5 Drawing Sheets

PISTOL-TYPE NOZZLE OF GARDENING SPRINKLER

BACKGROUND OF THE INVENTION

1. Field of the Invention

The present invention relates generally to a pistol-type nozzle, and more particularly to a connection structure of a spray head and a barrel of the pistol-type nozzle, and a trigger of the pistol-type nozzle.

2. Description of Related Art

The conventional pistol-type nozzle comprises a hand grip, a barrel extending from one end of the hand grip, a spray head fastened with a muzzle of the barrel, and a trigger fastened with the hand grip for activating the spraying mechanism of the pistol-type nozzle. The spray head and the muzzle are fastened together by an L-shaped mortise-tenon structure. The spray head and the muzzle are apt to separate from each other when the spray head is inadvertently pistol-type nozzle is integrally made of a rigid plastic material by injection molding and is therefore devoid of a soothing effect.

SUMMARY OF THE INVENTION

The primary objective of the present invention is to provide a pistol-type nozzle which is free of the deficiencies of the prior art nozzle described above.

In keeping with the principle of the present invention, the foregoing objective of the present invention is attained by a pistol-type nozzle comprising a hand grip, a barrel, a spray head, and a trigger. The muzzle of the barrel is provided in the outer wall with an annular groove and two retaining slots. The spray head is provided in the inner wall with two retaining projections corresponding in location to the retaining slots of the muzzle. The spray head is fastened with the muzzle in conjunction with a washer which is located in the annular groove of the muzzle. The retaining projections of the spray head are securely located in the retaining slots of the muzzle such that the retaining projections are arrested by an arresting ridge extending from the bottom wall of the retaining slots. The trigger has a press portion which is provided with a cover having a soothing effect.

The features and the advantages of the present invention will be more readily understood upon a thoughtful deliberation of the following detailed description of the present invention with reference to the accompanying drawings.

DETAILED DESCRIPTION OF THE INVENTION

As shown in FIGS. 1–5, a pistol-type nozzle 10 of the present invention comprises a hand grip 11, a barrel extending from the hand grip 11 and having a muzzle 12, and a spray head 20 fastened with the muzzle 12.

Figure 1:
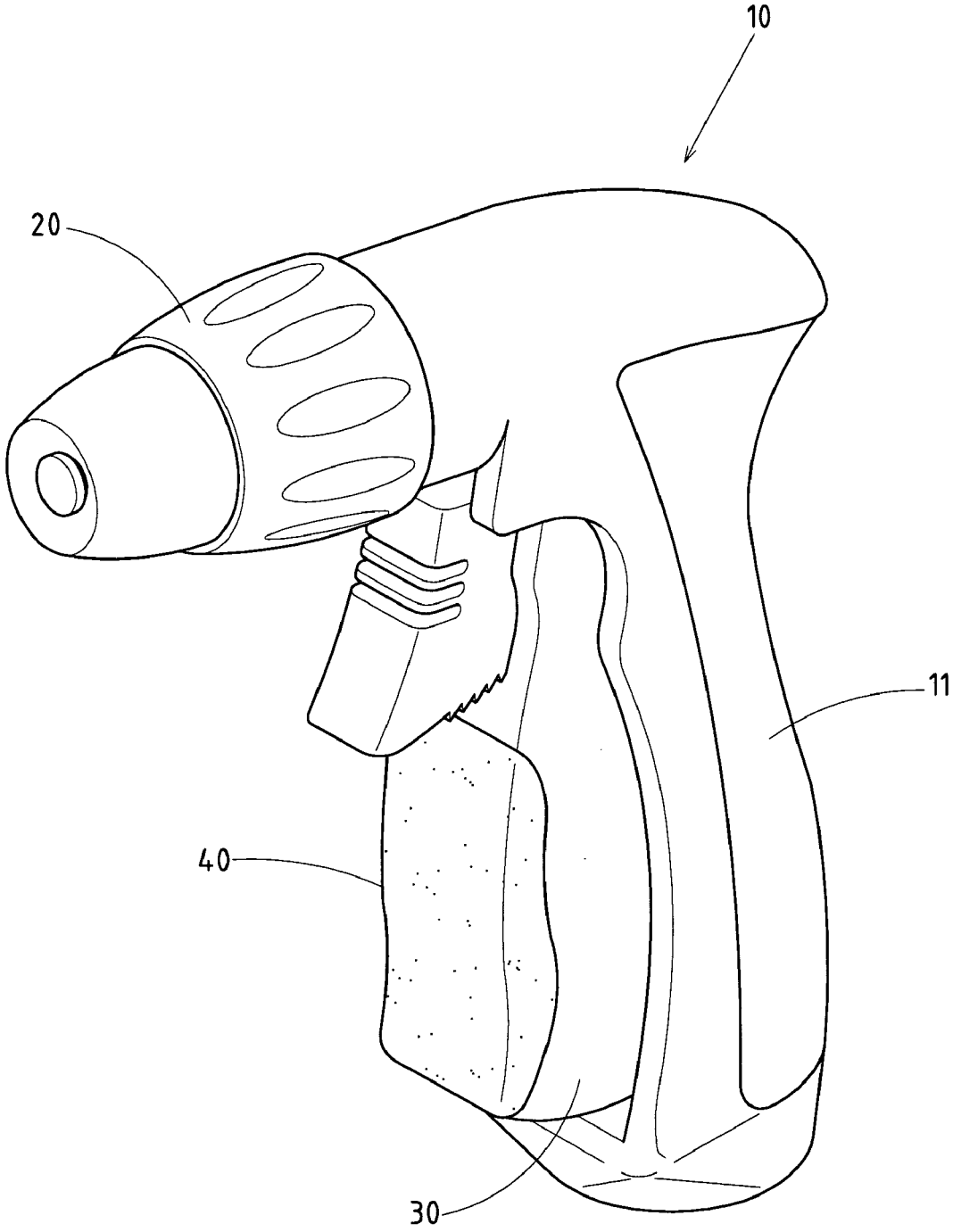
FIG. 1 shows a perspective view of the present invention.
Figure 2:
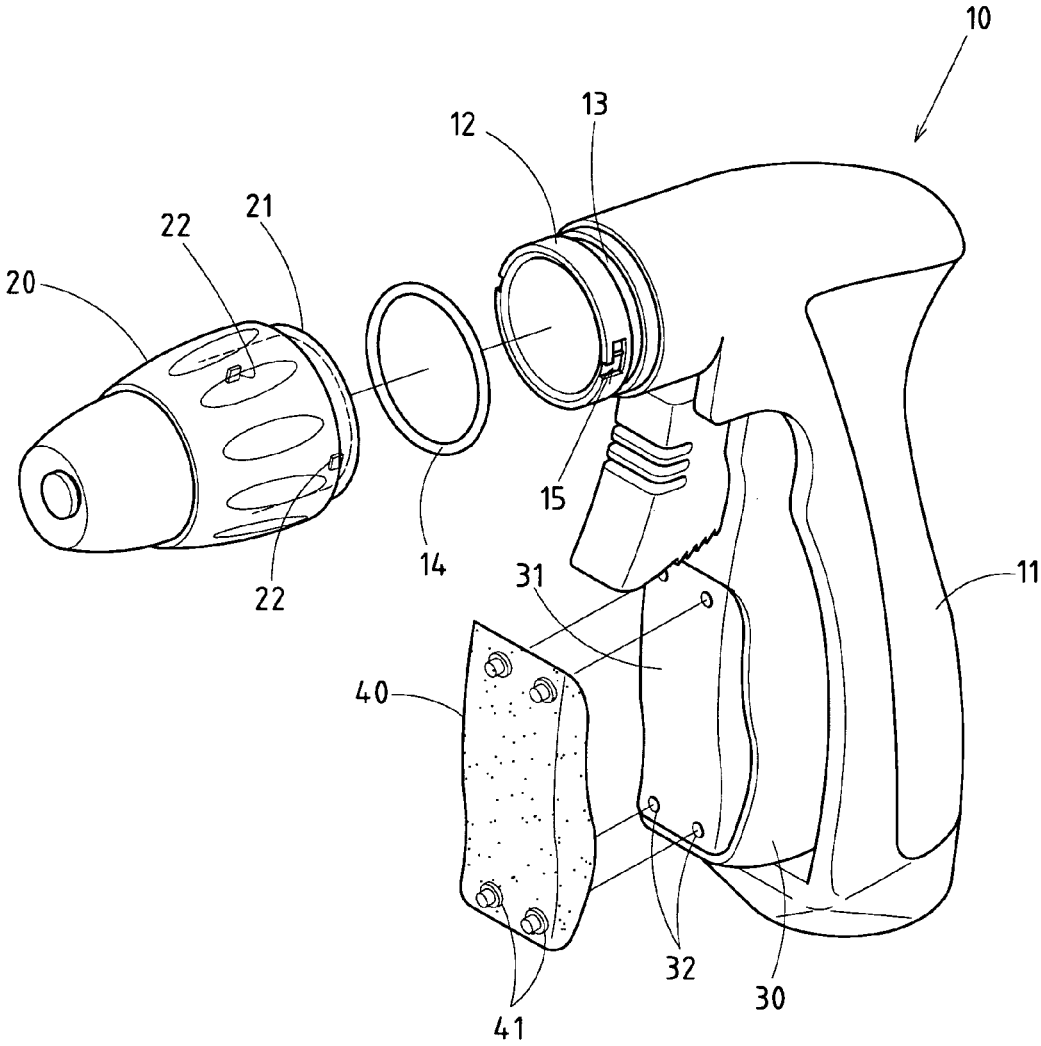
FIG. 2 shows an exploded view of the present invention.
Figure 3:
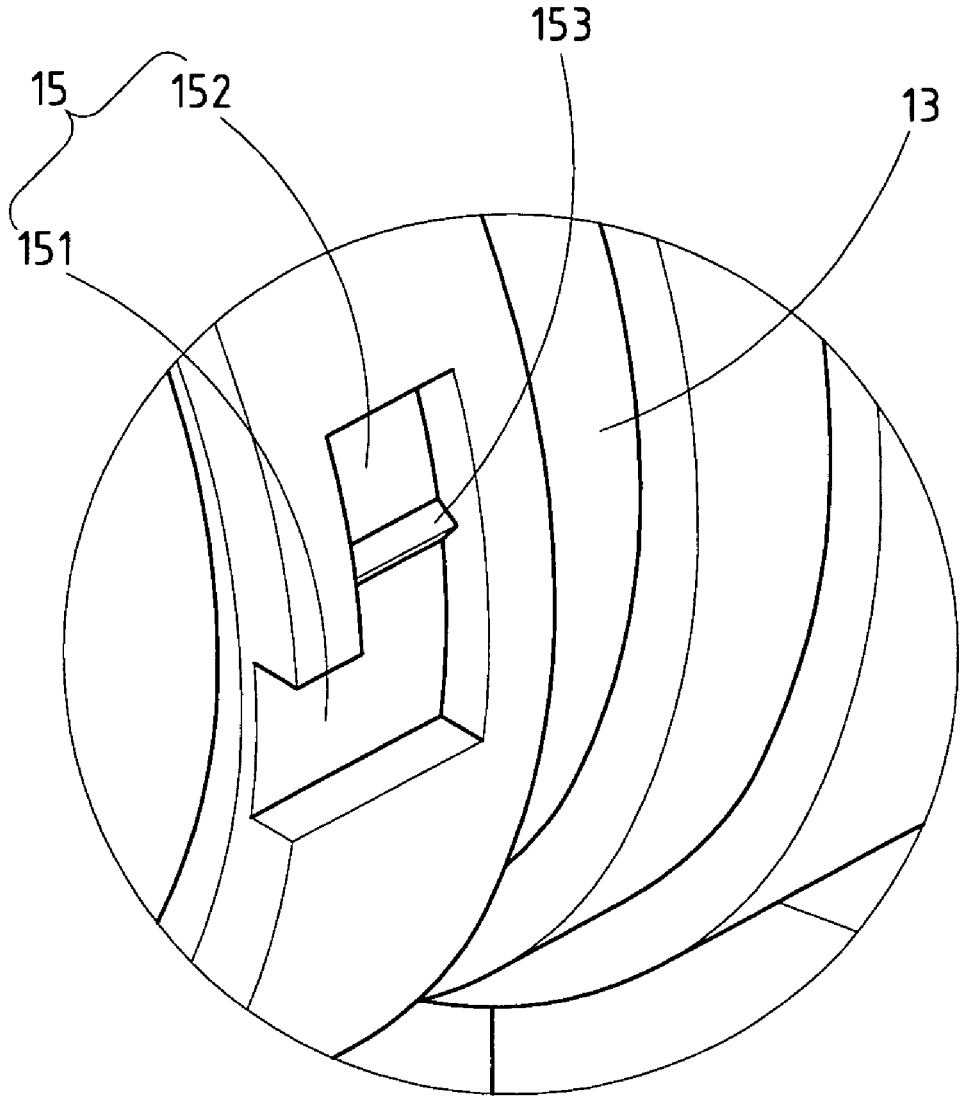
FIG. 3 shows a partial enlarged portion of the outer wall of the muzzle of the barrel of the present invention.

The muzzle 12 is provided in the outer wall with an annular groove 13, and two L-shaped retaining slots 15. The retaining slots 15 are opposite in location to each other and are formed of a guide portion 151 and a retaining portion 152, as shown in FIG. 3. The retaining portion 152 is provided in the bottom wall with a retaining ridge 153.

Figure 4:
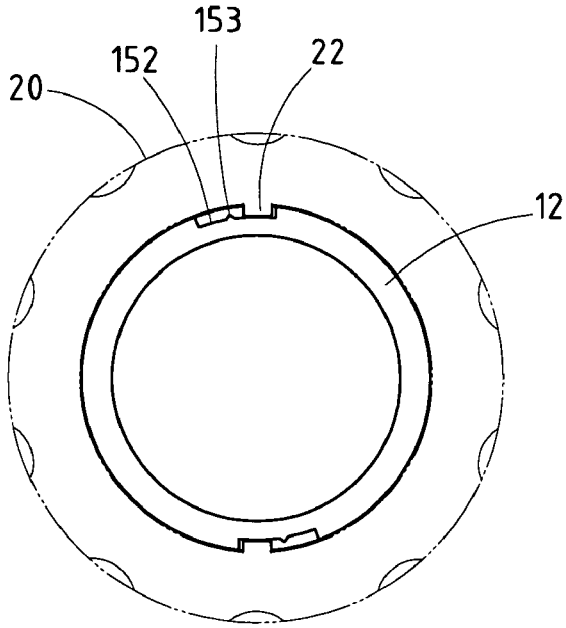
FIG. 4 shows a cross-sectional view of the retaining projections of the spray head and the retaining slots of the muzzle of the present invention.
Figure 5:
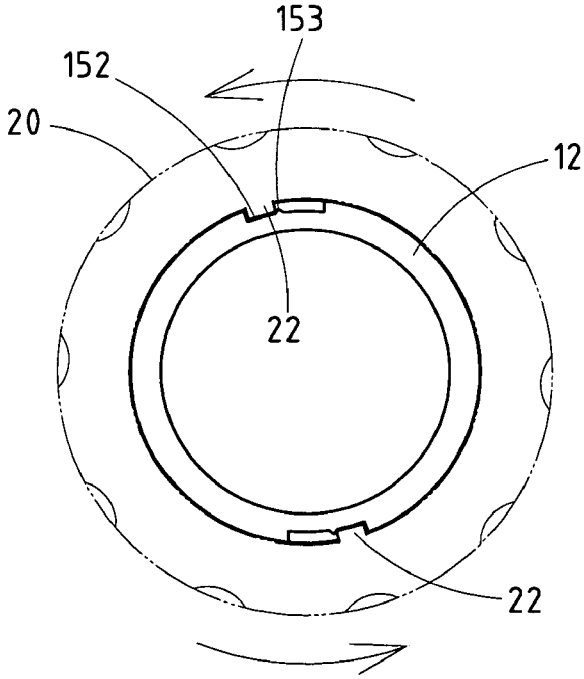
FIG. 5 is a cross-sectional schematic view to show that the retaining projection of the spray head is arrested by the arresting ridge of the retaining slot of the muzzle of the present invention.

The spray head 20 is provided with a connection end 21 and is further provided in the inner wall in proximity of the connection end 21 with two retaining projections 22 corresponding in location to the retaining slots 15 of the muzzle 12. The connection end 21 of the spray head 20 is joined with the muzzle 12 in conjunction with a washer 14 which is located in the annular groove 13 of the muzzle 12. The spray head 20 and the muzzle 12 are held together by the retaining projections 22, which are securely located in the retaining portion 152 of the retaining slot 15 such that the retaining projections 22 are arrested by the retaining ridge 153 of the retaining portions 152, as illustrated in FIGS. 4 and 5. In the process of joining the connection end 21 of the spray head 20 with the muzzle 12, the retaining projections 22 of the spray head 20 are inserted into the retaining slots 15 of the muzzle 12 via the guide portion 151 of the retaining slots 15.

Figure 6:
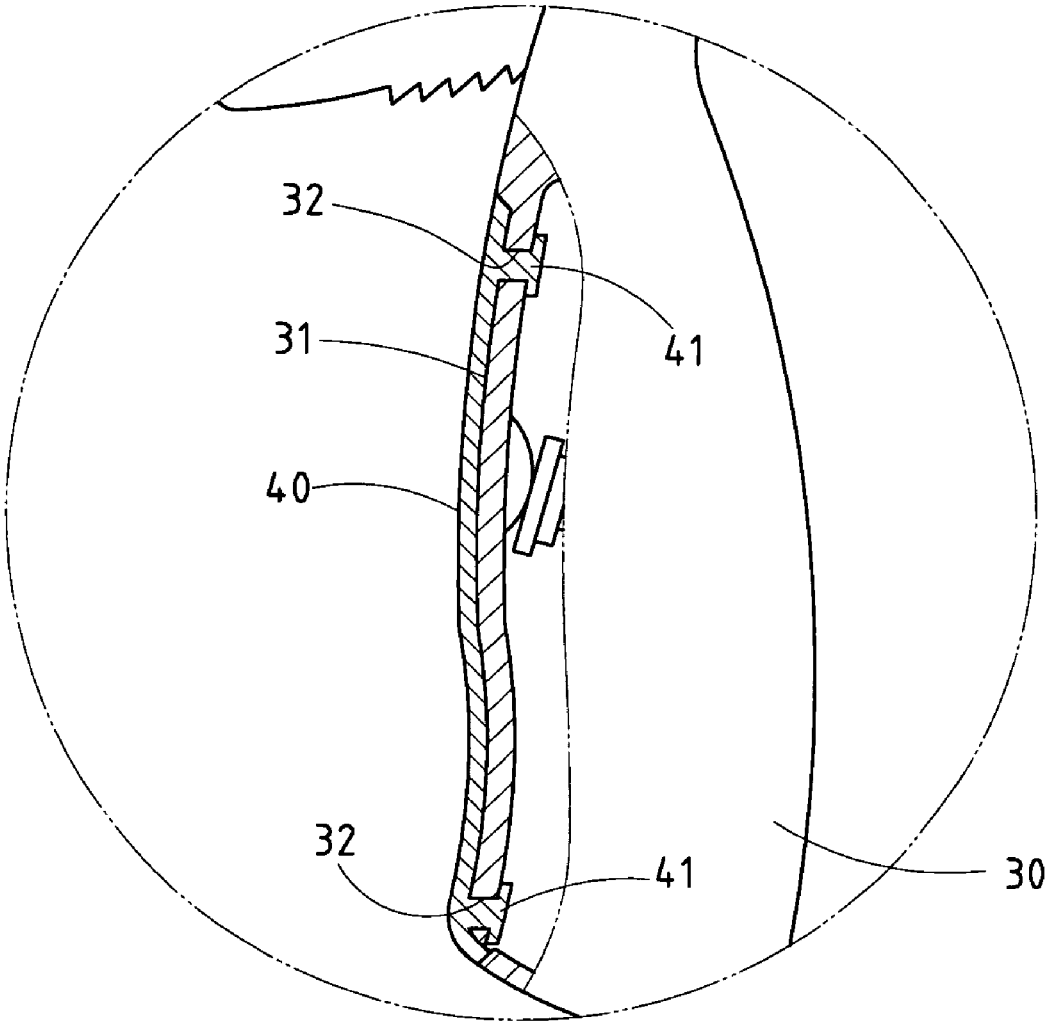
FIG. 6 shows a longitudinal sectional view of the trigger of the pistol-type nozzle of the present invention.

The pistol-type nozzle 10 of the present invention further comprises a trigger 30, which is fastened to the hand grip 11. The trigger 30 is pressed by the finger to activate the spraying mechanism of the pistol-type nozzle 10 of the present invention. The trigger 30 has a press portion which is provided with a recess 31 to accommodate a cover 40. The recess 31 is provided in the bottom wall with a plurality of retaining holes 32. The cover 40 is provided in the underside with a plurality of retaining protrusions 41 corresponding in location to the retaining holes 32. The cover 40 is securely held in the recess 31 of the trigger 30 such that the retaining protrusions 41 are retained in the retaining holes 32, as shown in FIG. 6. The cover 40 has a soothing effect. The cover 40 is made of a rubber material, or a foam material. The cover 40 is used to soothe the finger by which the trigger 30 is pressed to activate the spraying mechanism of the pistol-type nozzle 10 of the present invention.

The present invention described above is to be regarded in all respects as being illustrative and nonrestrictive. Accordingly, the present invention may be embodied in other specific forms without deviating from the spirit thereof. The present invention is therefore to be limited only by the scopes of the following claims.

I claim:

1. A pistol-type nozzle comprising:

a hand grip;

a barrel extending from one end of said hand grip and having a muzzle, said muzzle having an outer wall formed with an annular groove and two substantially L-shaped retaining slots, each of said retaining slots being formed of a guide portion and a retaining portion;

a spray head having a connection end mounted on said muzzle, said connection end having an inner wall formed with two inwardly extended retaining projections each detachably locked in a respective one of said retaining slots of said muzzle, each of said two retaining projections of said connection end being detachably retained in said retaining portion of said respective retaining slot via said guide portion of said respective retaining slot;

a washer mounted between said connection end and said muzzle and located in said annular groove of said muzzle; and a trigger fastened with said hand grip;

wherein said retaining portion of each of said two retaining slots of said muzzle is provided with a retaining ridge to arrest a respective one of said retaining projections of said connection end of said spray head;

wherein said trigger is provided with a cover fastened therewith;

wherein said trigger has a side wall formed with a recess and a plurality of retaining holes each communicating with said recess, and said cover is received in said recess of said trigger and has a side formed with a plurality of retaining protrusions each extended through a corresponding one of said retaining holes of said trigger and each having an enlarged distal end rested on said side wall of said trigger.

2. The pistol-type nozzle as defined in claim 1, wherein said cover is made of a rubber material.

3. The pistol-type nozzle as defined in claim 1, wherein said cover is made of a foam material.

4. The pistol-type nozzle as defined in claim 1, wherein said retaining ridge of said retaining portion of each of said retaining slots of said muzzle is substantially wedge-shaped.

* * * * *